US006309084B1

(12) United States Patent
Lin

(10) Patent No.: US 6,309,084 B1
(45) Date of Patent: Oct. 30, 2001

(54) LAMP SHOWING DYNAMICALLY CHANGEFUL LUSTER AND SHADOW

(76) Inventor: Rich Lin, 17F, No. 309, Sec. 2, Wen Hua Rd, Panchiao, Taipei Hsien (TW)

( * ) Notice: Subject to any disclaimer, the term of this patent is extended or adjusted under 35 U.S.C. 154(b) by 0 days.

(21) Appl. No.: 09/610,347

(22) Filed: Jul. 3, 2000

(51) Int. Cl.[7] ..... F21V 33/00

(52) U.S. Cl. ..... 362/101; 362/96; 362/806; 362/351; 40/409; 446/267

(58) Field of Search ..... 362/561, 101, 362/96, 351, 806; 40/409, 410, 442; 446/267

(56) References Cited

U.S. PATENT DOCUMENTS 2,860,232 * 11/1958 Gray ..... 40/409

4,072,856 * 2/1978 Marchese ..... 362/101

* cited by examiner

*Primary Examiner*—Sandra O'Shea
*Assistant Examiner*—John Anthony Ward
(74) *Attorney, Agent, or Firm*—Dougherty & Troxell

(57) ABSTRACT

A lamp has a transparent glass container in which a clear liquid having a plurality of colored lustrous foil fragments floating in the liquid is contained, and a frosted shade covering the glass container with a clearance left between them. Light projected by the lamp on the floating lustrous foil fragments is refracted onto the frosted shade to show dynamically changeful luster and shadow on the frosted shade, creating novel and unique decorative effect. The glass container and the frosted shade may be of any shape and may have different wall thickness at different locations to enhance the decorative effect of the lamp.

8 Claims, 8 Drawing Sheets

A – A

LAMP SHOWING DYNAMICALLY CHANGEFUL LUSTER AND SHADOW

BACKGROUND OF THE INVENTION

The present invention relates to a lamp, and more particularly to a lamp showing dynamically changeful luster and shadow.

FIGS. 1 and 2 are assembled and exploded perspective views, respectively, of a conventional lamp 10 showing floating and lustrous foil fragments. The lamp 10 includes a base 11, a transparent glass container 12 connected on a top of the base 11, and a top cover 13 covering a head opening of the glass container 12. The base 11 has a light-emitting means 111 mounted therein to produce hot light when the light-emitting means 111 is connected to an external power source (not shown). The transparent glass container 12 contains a low-boiling-point liquid 121 in which a plurality of differently colored lustrous foil fragments 122 float. When the light-emitting means 111 projects hot light to a bottom of the transparent glass container 12, the colored foil fragments 122 refracts differently colored rays. The hot light of the light-emitting means 111 also heats the bottom of the glass container 12 and causes the liquid 121 to convect in the container 12 and therefore bring the lustrous foil fragments 122 to move up and down in the container 12. The colored rays refracted from the lustrous foil fragments 122 make the lamp 10 an attractive ornament. Such lamp showing floating and lustrous foil fragments and colored rays of light has been introduced into the market for many years. Except some changes in the appearance, such lamp has no change in its display function at all during the past years. Due to the transparent glass container 12, consumers could easily see the floating and lustrous foil fragments 122 from outside of the lamp 10, and the lamp 10 is less attractive to the consumers after it has been used for a period of time. It is therefore tried by the inventor to develop a lamp showing dynamically changeful luster and shadow to create a different decorative effect for the lamp 10.

SUMMARY OF THE INVENTION

A primary object of the present invention is to provide a lamp having a frosted shade to show dynamically changeful luster and shadow on the lamp.

Another object of the present invention is to provide a lamp having a frosted shade that can be differently shaped to create novel and unique appearance for the lamp and show more changeful luster and shadow on the shade.

To achieve the above and other objects, the lamp of the present invention mainly includes a transparent glass container in which a clear liquid having a plurality of colored lustrous foil fragments floating in the liquid is contained, and a frosted shade covering the glass container with a clearance left between them. Light projected by the lamp on the floating lustrous foil fragments is refracted onto the frosted shade to show dynamically changeful luster and shadow on the frosted shade, creating novel and unique decorative effect. The glass container and the frosted shade may be of any shape and may have different wall thickness to enhance the decorative effect of the lamp.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
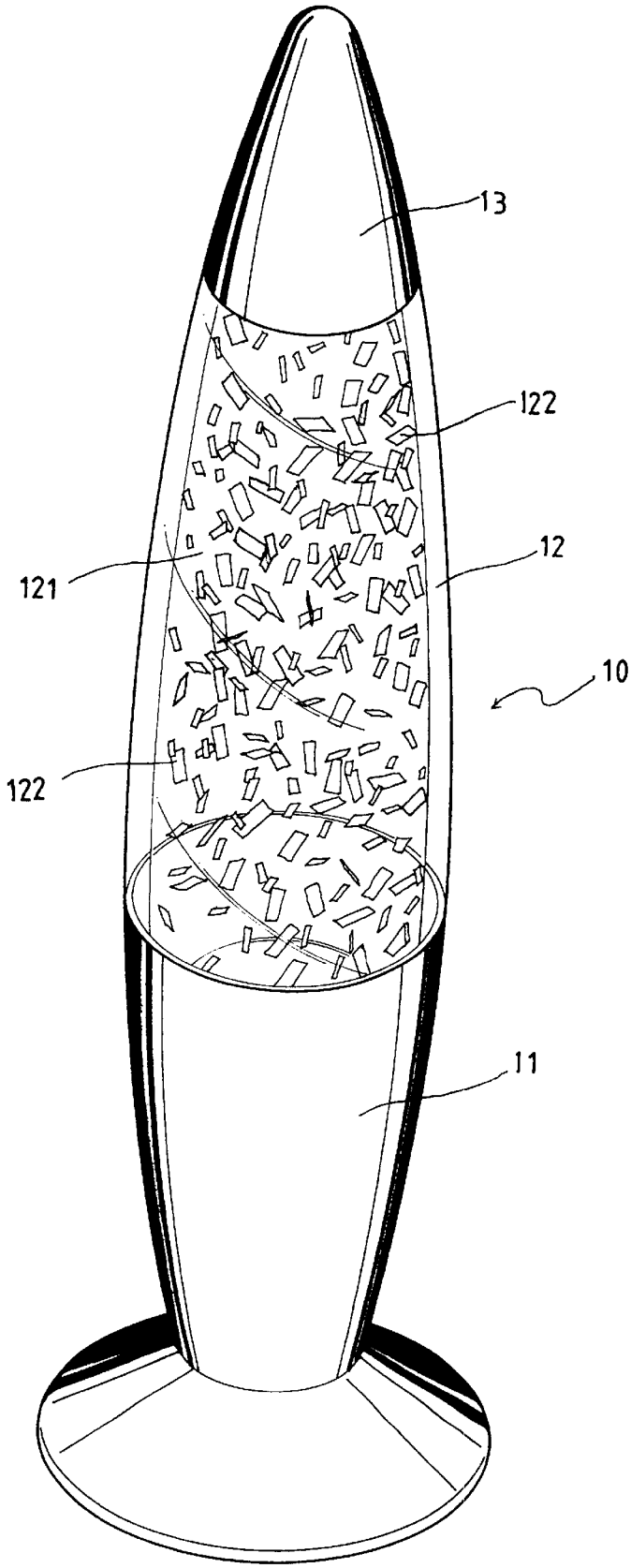
FIG. 1 (PRIOR ART)
FIG. 1 is a perspective of a conventional lamp showing floating and lustrous foil fragments.
Figure 2:
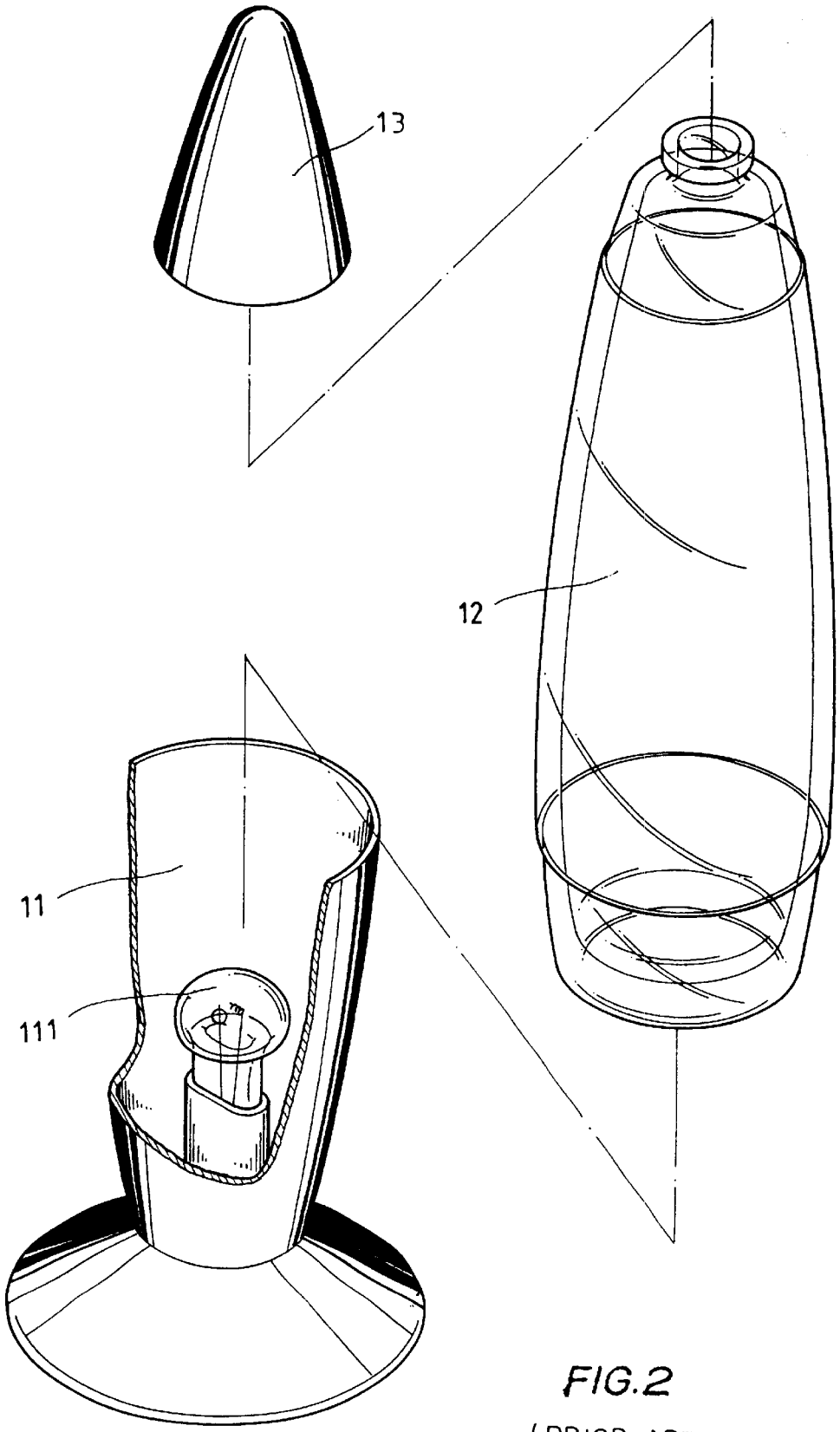
FIG.2 (PRIOR ART)
FIG. 2 is an exploded perspective of the conventional lamp of FIG. 1.
Figure 3:
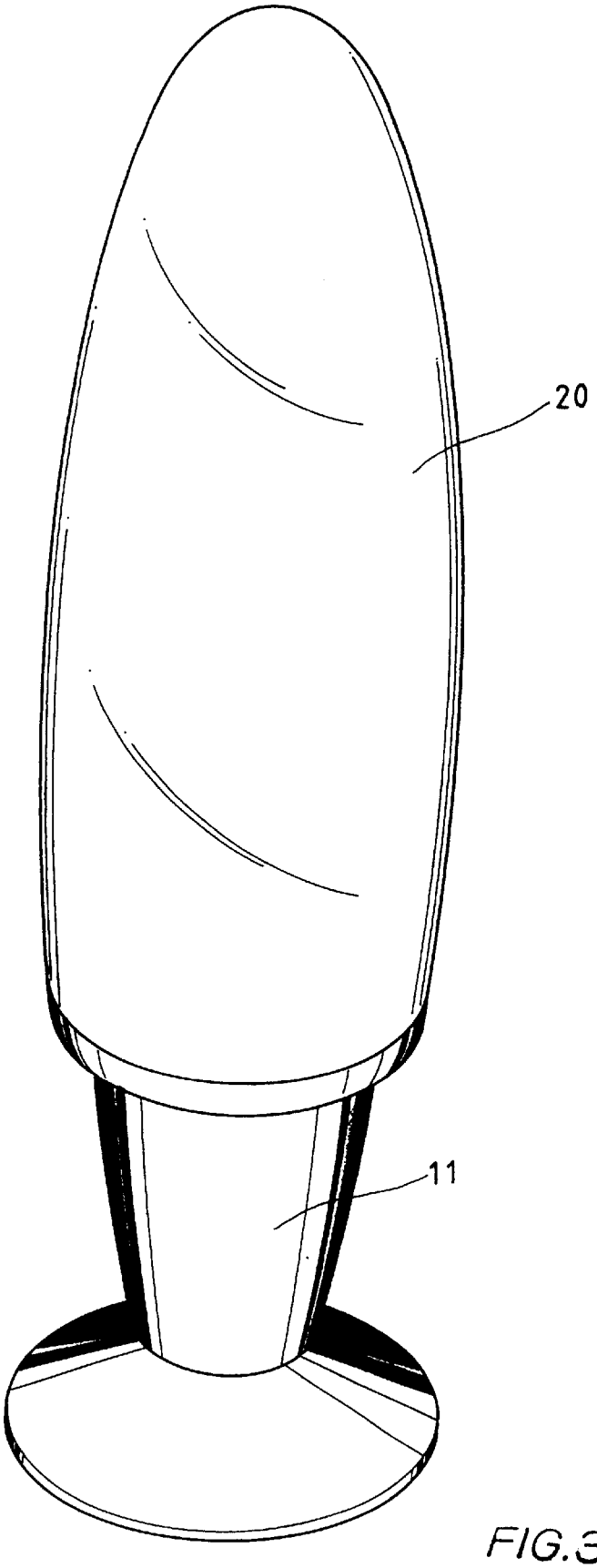
FIG. 3 is an assembled perspective of a lamp showing dynamically changeful luster and shadow according to a first embodiment of the present invention.
Figure 4:
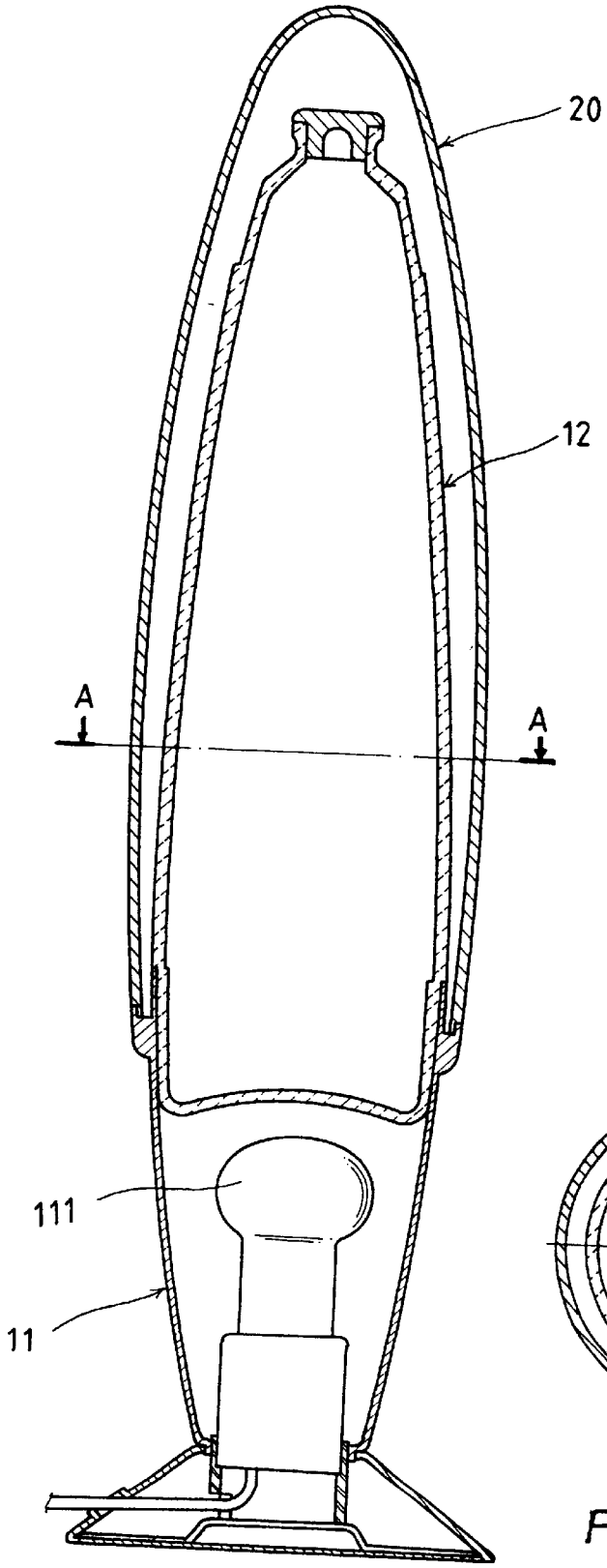
FIG. 4 is a vertical sectional view of the lamp of FIG. 3.
Figure 5:
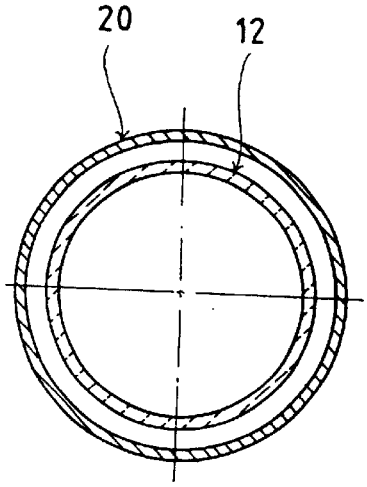
FIG. 5 is a cross sectional view taken on line A—A of FIG. 4.

Please refer to FIGS. 3 and 4 that are assembled perspective and sectional views, respectively, of a lamp showing dynamically changeful luster and shadow according to a first embodiment of the present invention, and to FIG. 5 that is a cross sectional view taken on line A—A of FIG. 4. As the conventional lamp 10 shown in FIGS. 1 and 2, the lamp according to the first embodiment of the present invention as shown in FIGS. 3 and 4 includes a base 11 in which a light-emitting means 111 is mounted and a transparent glass container 12 in which decorative things, such as a low-boiling-point liquid and a plurality of floating and lustrous foil fragments 122 (not shown in FIGS. 3 and 4) are contained. The lamp of the present invention is not necessarily provided with a top cover 13, depending on designs for the lamp, and the base 11 and the transparent glass container 12 thereof may be of any shape and contour. The lamp of the present invention is characterized in a thin layer of shade 20 made of a general plastic material and mounted on the base outside the glass container 12, such that a predetermined clearance is left between the glass container 12 and the shade 20. The shade 20 has a frosted surface so that it is light-penetrable but vision-impenetrable. With the frosted shade 20, differently colored rays of light refracted by the floating and lustrous foil fragments 122 in the transparent glass container 12 all project on the frosted shade 20, forming dynamically changeful luster and shadow on the shade 20 to create novel and unique decorative effect.

Figure 6:
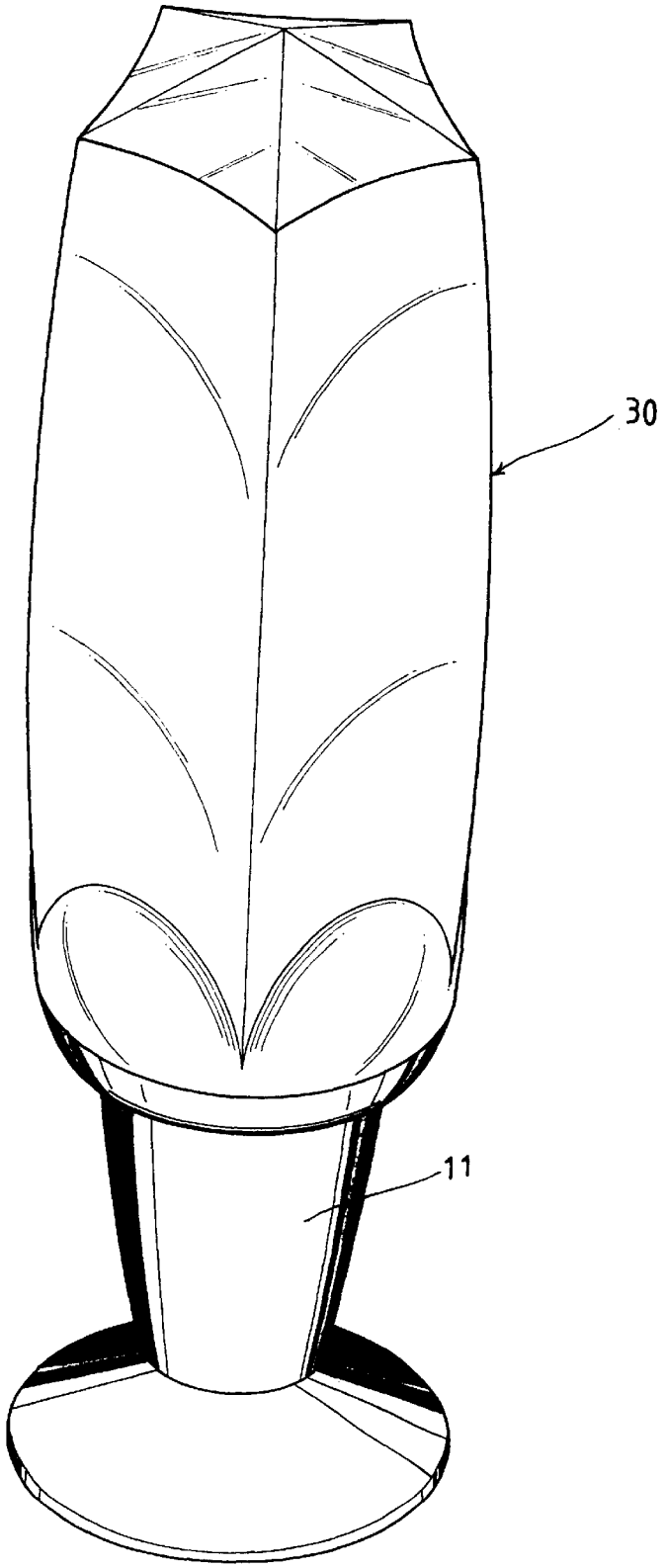
FIG. 6 is an assembled perspective of a lamp showing dynamically changeful luster and shadow according to a second embodiment of the present invention.
Figure 7:
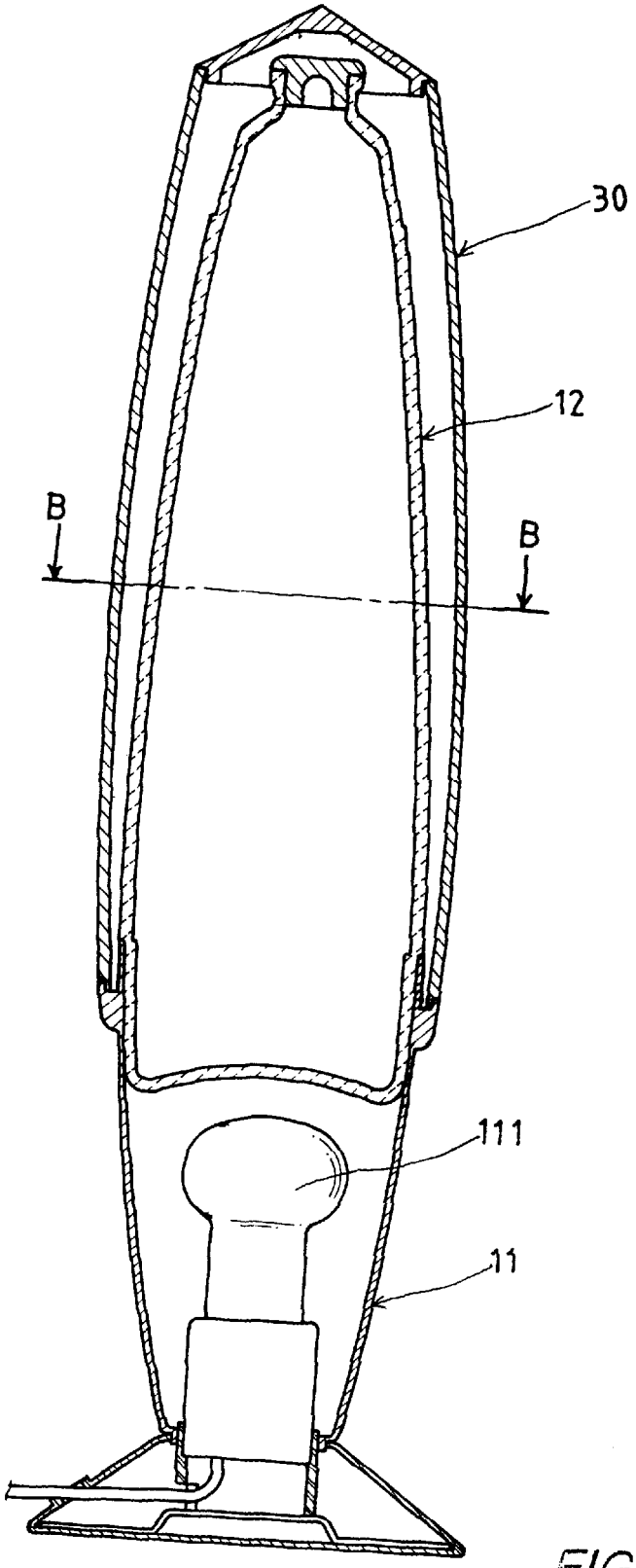
FIG. 7 is a vertical sectional view of the lamp of FIG. 6.
Figure 8:
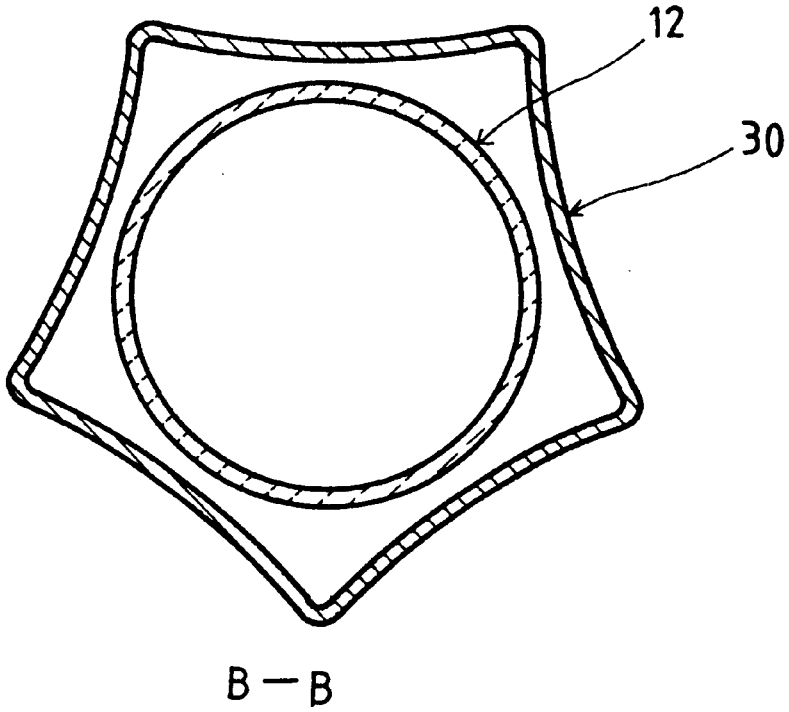
FIG. 8 is a cross sectional view taken on line B—B of FIG. 7.

The frosted shade covering the glass container 12 of the lamp of the present invention may be differently shaped. The frosted shade 20 in the first embodiment of the present invention has even thickness from top to bottom and is an upward tapered long shell having a round cross section. As can be seen from FIG. 5, the frosted shade 20 is substantially concentric with the container 12 in this first embodiment. FIGS. 6 and 7 are assembled perspective and sectional views, respectively, of a lamp showing dynamically changeful luster and shadow according to a second embodiment of the present invention. In this second embodiment, the lamp has a frosted shade 30 being mounted outside the glass container 12 with a predetermined clearance left between them. As can be seen from FIGS. 7 and 3, the frosted shade 30 is an upward tapered long shell having a polygonal cross section and has even thickness from top to bottom. Each side surface of the polygonal shade 30 is slightly concaved, so that the clearance between the shade 30 and the glass container 12 varies at different locations to create more changes in the dynamic luster and shadow on the frosted shade 30 when the light from the lamp is refracted from the foil fragments 122 and projected on the shade 30.

Figure 9:
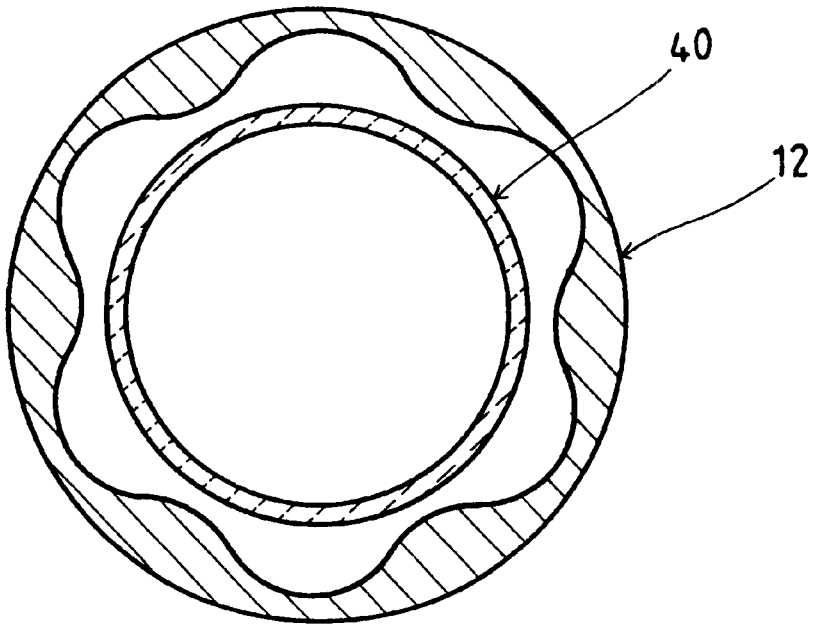
FIG. 9 is a cross sectional view of a lamp showing dynamically changeful luster and shadow according to a third embodiment of the present invention.

FIG. 9 is a cross sectional view of a lamp according to a third embodiment of the present invention. In this third embodiment, the lamp has a shade 40 that is generally concentric with the glass container 12 but has thickness varied at different locations.

Figure 10:
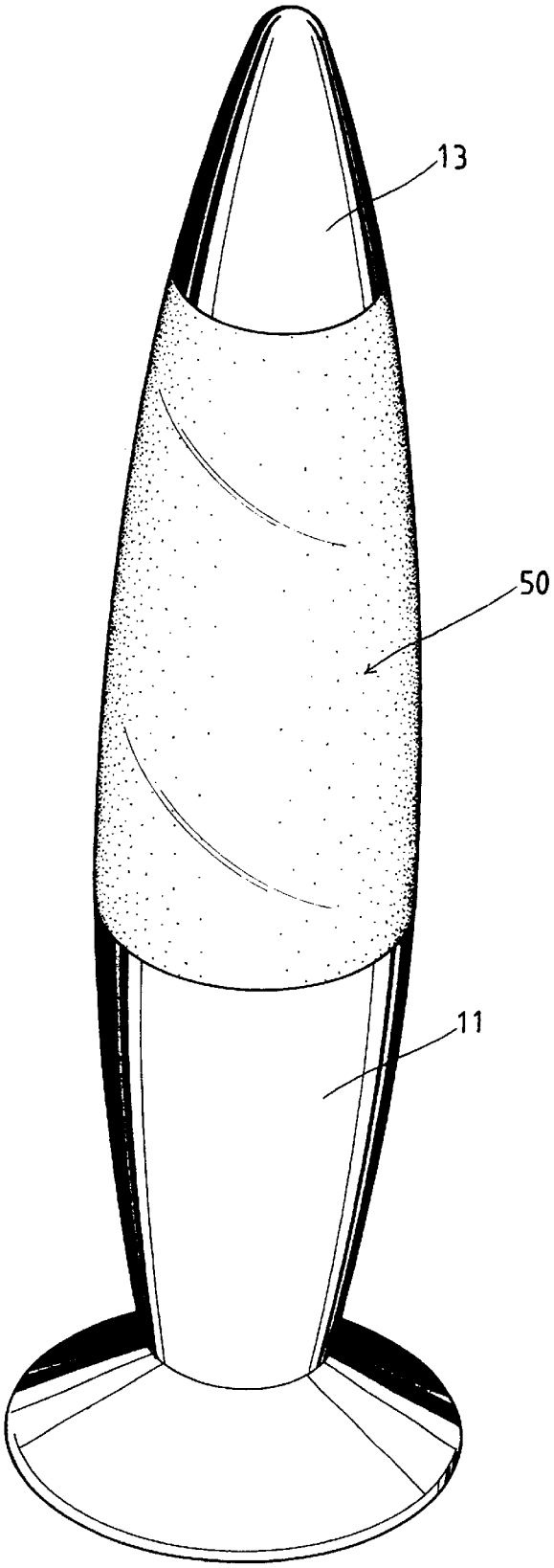
FIG. 10 is an assembled perspective of a lamp showing dynamically changeful and luster shadow according to a fourth embodiment of the present invention.

A main purpose of the frosted shade 20, 30 or 40 is to obscure the transparent glass container 12, so that the lustrous foil fragments 122 in the glass container 12 could not be viewed directly from outside of the lamp. Light projected from, for example, a bulb of the lamp is refracted by the lustrous foil fragments 122 floating in the glass container 12 to project on the frosted shade 20, 30 or 40, forming on the shade dynamically changeful luster and shadow that could be viewed directly from outside of the lamp. It is also possible to omit the shade and for the glass container 12 to have a frosted outer surface 50, as shown in FIG. 10, so that dynamically changeful and luster and shadow are directly created on the surface of the glass container 12 to achieve the same decorative effect. The frosted surface 50 on the glass container 12 may be obtained by attaching a sheet of frosted paper to the outer surface of the glass container 12 or directly frosting the outer surface of the glass container 12.

It is understood that the present invention is illustrated with the description of some preferred embodiments thereof, and it is contemplated that many changes and modifications in the described embodiments can be carried out without departing from the scope of the invention. For example, the lamp may be so designed that the base 11 is also covered by the frosted shade and therefore invisible from outside of the lamp, or the frosted shade is connected to the base 11 in different ways, or the frosted shade is provided with a small transparent area so that it is locally vision-penetrable. All these changes enable the lamp to have changeful appearance and should be considered as an equivalent of the present invention. In brief, the scope of the present invention is intended to be limited only by the appended claims.

What is claimed is:

1. A lamp showing dynamically changeful luster and shadow, comprising a base in which a light-emitting means is mounted, a transparent glass container connected to a top of said base for containing a low-boiling-point clear liquid and a plurality of differently colored lustrous foil fragments floating in said clear liquid, and a thin shell of frosted shade that is light-penetrable and vision-impenetrable and covers an outer surface of said transparent glass container with a predetermined clearance left between said shade and said glass container; said light-emitting means projecting hot light upward and therefore heating a bottom of said transparent glass container to cause said clear liquid to convect in said glass container and bring said lustrous foil fragments floating in said clear liquid to move up and down in said glass container, light projected by said light-emitting means onto said differently colored lustrous foil fragments being refracted to produce colored rays of light that penetrate said transparent glass container and project on said frosted shade and therefore forming dynamically changeful luster and shadow on said frosted shade that can be viewed from outside of said frosted shade.

2. A lamp showing dynamically changeful luster and shadow as claimed in claim 1, wherein said frosted shade may be of any shape.

3. A lamp showing dynamically changeful luster and shadow as claimed in claim 1, wherein said frosted shade is a shell having a convex wall surface and an even wall thickness, and said clearance between said frosted shade and said glass container being substantially the same at all locations.

4. A lamp showing dynamically changeful luster and shadow as claimed in claim 2, wherein said frosted shade is a shell having a convex wall surface and an even wall thickness, and said clearance between said frosted shade and said glass container being substantially the same at all locations.

5. A lamp showing dynamically changeful luster and shadow as claimed in claim 1, wherein said frosted shade is a shell having a polygonal cross section and an even wall thickness, and each side of said polygonal shade being a concave wall surface, so that said clearance between said frosted shade and said glass container varies at different locations.

6. A lamp showing dynamically changeful luster and shadow as claimed in claim 2, wherein said frosted shade is a shell having a polygonal cross section and an even wall thickness, and each side of said polygonal shade being a concave wall surface, so that said clearance between said frosted shade and said glass container varies at different locations.

7. A lamp showing dynamically changeful luster and shadow as claimed in claim 1, wherein said frosted shade is a shell having uneven wall thickness.

8. A lamp showing dynamically changeful luster and shadow as claimed in claim 2, wherein said frosted shade is a shell having uneven wall thickness.

* * * * *